US007828080B2

(12) United States Patent
Burkhard et al.

(10) Patent No.: US 7,828,080 B2
(45) Date of Patent: Nov. 9, 2010

(54) DISTRIBUTED INTELLIGENCE FOR ENHANCED MONITORING AND CONTROL OF OILFIELD PROCESSES

(75) Inventors: Alan Wayne Burkhard, Edmond, OK (US); Mario Zamora, Houston, TX (US)

(73) Assignee: M-I L.L.C., Houston, TX (US)

( * ) Notice: Subject to any disclaimer, the term of this patent is extended or adjusted under 35 U.S.C. 154(b) by 266 days.

(21) Appl. No.: 11/837,145

(22) Filed: Aug. 10, 2007

(65) Prior Publication Data

US 2008/0035375 A1 Feb. 14, 2008

Related U.S. Application Data

(60) Provisional application No. 60/822,351, filed on Aug. 14, 2006.

(51) Int. Cl.
*E21B 44/00* (2006.01)

(52) U.S. Cl. ..... 175/24; 175/38; 175/40; 175/48

(58) Field of Classification Search ..... 175/38, 175/48, 24, 40, 206, 207
See application file for complete search history.

(56) References Cited

U.S. PATENT DOCUMENTS 4,635,735 A * 1/1987 Crownover ..... 175/48
4,636,934 A 1/1987 Schwendemann et al.
4,747,060 A 5/1988 Sears, III et al.
4,751,648 A 6/1988 Sears, III et al.
4,954,923 A 9/1990 Hoeflich et al.
5,190,645 A * 3/1993 Burgess ..... 210/144
5,335,730 A 8/1994 Cotham, III et al.
5,583,764 A 12/1996 Nail et al.
5,680,899 A 10/1997 Waid et al.
5,712,631 A 1/1998 Lewis et al.
5,838,589 A 11/1998 Nail et al.
6,154,683 A 11/2000 Kessler et al.
6,305,471 B1 10/2001 Milloy et al.
6,308,787 B1 10/2001 Alft
6,397,322 B1 5/2002 Voss
6,574,652 B2 6/2003 Burkhard
6,693,553 B1 2/2004 Ciglenec et al.

(Continued)

FOREIGN PATENT DOCUMENTS

KR 100467753 A 1/2005

OTHER PUBLICATIONS

PCT International Search Report issued in PCT Application No. PCT/US2007/075867 dated Dec. 12, 2007 (3 pages).

(Continued)

*Primary Examiner*—Giovanna C Wright
(74) *Attorney, Agent, or Firm*—Osha Liang LLP

(57) ABSTRACT

A method for controlling a peripheral drilling operation involves obtaining a first property of a first drilling operation component associated with the peripheral drilling operation, via a wireless network, obtaining a second property of a second drilling operation component associated with the peripheral drilling operation, generating a control signal for the first drilling operation component, based on the first property and the second property, and communicating the control signal to the first drilling operation component, via the wireless network, where the first drilling operation component is adjusted, based on the control signal, to control the peripheral drilling operation.

21 Claims, 8 Drawing Sheets

U.S. PATENT DOCUMENTS

| | | | | |
|---|---|---|---|---|
| 6,885,949 | B2 | 4/2005 | Selli | |
| 6,963,817 | B2 | 11/2005 | Ito et al. | |
| 6,967,589 | B1 | 11/2005 | Peters | |
| 6,985,831 | B2 | 1/2006 | Ito et al. | |
| 6,998,998 | B2 | 2/2006 | Thomas | |
| 7,119,572 | B2 | 10/2006 | Malik et al. | |
| 7,236,342 | B2 | 6/2007 | Vazach et al. | |
| 7,263,459 | B2 | 8/2007 | Ito et al. | |
| 2002/0108786 | A1* | 8/2002 | Rowden | 175/57 |
| 2002/0195247 | A1 | 12/2002 | Ciglenec et al. | |
| 2003/0204371 | A1 | 10/2003 | Sciamanna | |
| 2005/0068710 | A1 | 3/2005 | Burr et al. | |
| 2006/0146469 | A1 | 7/2006 | Heagerty et al. | |
| 2007/0103324 | A1* | 5/2007 | Kosuge et al. | 340/618 |

OTHER PUBLICATIONS

PCT Written Opinion issued in PCT Application No. PCT/US2007/075867 dated Dec. 12, 2007 (4 pages).

English Patent Abstract of KR100467753 from the Korean Patent Office website, published Dec. 31, 2003 (2 pages).

Office Action issued in related Canadian Application No. 2,660,116 dated Mar. 29, 2010 (3 pages).

* cited by examiner

DISTRIBUTED INTELLIGENCE FOR ENHANCED MONITORING AND CONTROL OF OILFIELD PROCESSES

CROSS-REFERENCE TO RELATED APPLICATIONS

This application claims priority, pursuant to 35 U.S.C. §119(e) to U.S. Patent Application Ser. No. 60/822,351, filed on Aug. 14, 2006, which is herein incorporated by reference in its entirety.

FIELD OF THE INVENTION

Embodiments disclosed herein relate generally to methods and systems involving the control of peripheral drilling operations.

BACKGROUND

FIG. 1 shows a diagram of an exemplary drilling system for drilling an earth formation. Those having ordinary skill in the art will appreciate that a number of other types of drilling systems—for example, deep sea drilling—also exist. Specifically, FIG. 1 shows a diagram of a drilling rig (100) used to turn a drill bit (150) coupled at the distal end (i.e., the end furthest below the ground surface) of a drill pipe (140) in a borehole (145). The drilling system may be used for obtaining oil, natural gas, water, or any other type of material obtainable through drilling.

Specifically, the drill pipe (140) is configured to transmit rotational power generated by a rotary table (125) from the drilling rig (100) to the drill bit (150), and to transmit drilling fluid through the drill pipe's (140) hollow core to the drill bit (150). The drilling fluid may also be referred to as "mud." A mud pump (180) is used to transmit the mud through a stand pipe (160), hose (155), and kelly (120) into the drill pipe (140).

When drilling, pressure within the borehole (145) may result in a blowout, i.e., an uncontrolled flow of fluids that may reach the ground surface. In some cases, a blowout may be so severe as to cause injury to those operating the drilling rig (100), and may render the drilling rig (100) inoperable. Accordingly, a blowout preventer (130) may be used to control fluid pressure within the borehole (145). Further, the borehole (145) may be reinforced using a casing (135), to prevent collapse due to a blowout or other forces operating on the borehole (145).

The drilling rig (100) may also include other components such as a crown block (105), traveling block (110), swivel (115), and other components not shown.

Mud returning to the surface from the borehole (145) is directed to mud treatment equipment via a mud return line (165). For example, the mud may be directed to a shaker (170) configured to remove drilled solids from the mud. The removed solids are transferred to a reserve pit (175), while the mud is deposited in a mud pit (190). The mud pump (180) pumps the filtered mud from the mud pit (190) via a mud suction line (185), and re-injects the filtered mud into the drilling rig (100).

In some cases, other mud treatment devices may be used. FIG. 2 shows a diagram of an exemplary arrangement of mud treatment devices. As described above, mud arrives at a shaker (210) via a mud return line (205). Solids removed by the shaker are transferred to a reserve pit (215). The mud is then transferred to a degasser (220) configured to remove air or other gasses from the mud. Further, a desander (225), desilter (230), and centrifuge (235) are configured to remove additional solids, of increasing granularity, from the mud. Finally, additives are added to the mud via a mixing hopper (240), and a mud pump (250) pumps the treated mud through a mud suction line (245) to the drilling rig. In some cases, one or more of the aforementioned mud treatment devices may not be used, or may be arranged in a different order.

Operation of the mud treatment devices described above may be referred to, individually or in combination, as a "peripheral drilling operation," i.e., a drilling-related operation that is not directly associated with rotation of the drill bit. Other types of peripheral drilling operation include, for example, fluid engineering, drilling simulation, pressure control, wellbore cleanup, waste management, etc.

SUMMARY

In general, in one aspect, disclosed embodiments relate to a method for controlling a peripheral drilling operation. The method comprises obtaining a first property of a first drilling operation component associated with the peripheral drilling operation, via a wireless network, obtaining a second property of a second drilling operation component associated with the peripheral drilling operation, generating a control signal for the first drilling operation component, based on the first property and the second property, and communicating the control signal to the first drilling operation component, via the wireless network, wherein the first drilling operation component is adjusted, based on the control signal, to control the peripheral drilling operation.

In general, in one aspect, disclosed embodiments relate to a system for controlling a peripheral drilling operation. The system comprises a first microcontroller configured to obtain a first property of a first drilling operation component associated with the peripheral drilling operation, and communicate the first property to a system administration module, via a wireless network, and the system administration module configured to determine a control signal for the first drilling operation component, based on the first property and a second property of a second drilling operation component associated with the peripheral drilling operation, and communicate the control signal to the first microcontroller, via the wireless network, wherein the first drilling operation component is adjusted, based on the control signal, to control the peripheral drilling operation.

In general, in one aspect, disclosed embodiments relate to a method for controlling a peripheral drilling operation. The method comprises obtaining a first property of a first drilling operation component associated with the peripheral drilling operation, obtaining a second property of a second drilling operation component associated with the peripheral drilling operation, communicating the first property to a microcontroller associated with the second drilling operation component, via a wireless network, and adjusting the second drilling operation component, based on the first property and the second property, to control the peripheral drilling operation.

In general, in one aspect, disclosed embodiments relate to a system for controlling a peripheral drilling operation. The system comprises a first microcontroller configured to obtain a first property of a first drilling operation component associated with the peripheral drilling operation, and communicate the first property to a second microcontroller, via a wireless network, and the second microcontroller configured to obtain a second property of a second drilling operation component associated with the drilling process, and adjust the second drilling operation component, based on the first property and the second property.

Other aspects of disclosed embodiments will be apparent from the following description and the appended claims.

DETAILED DESCRIPTION

Figure 1:
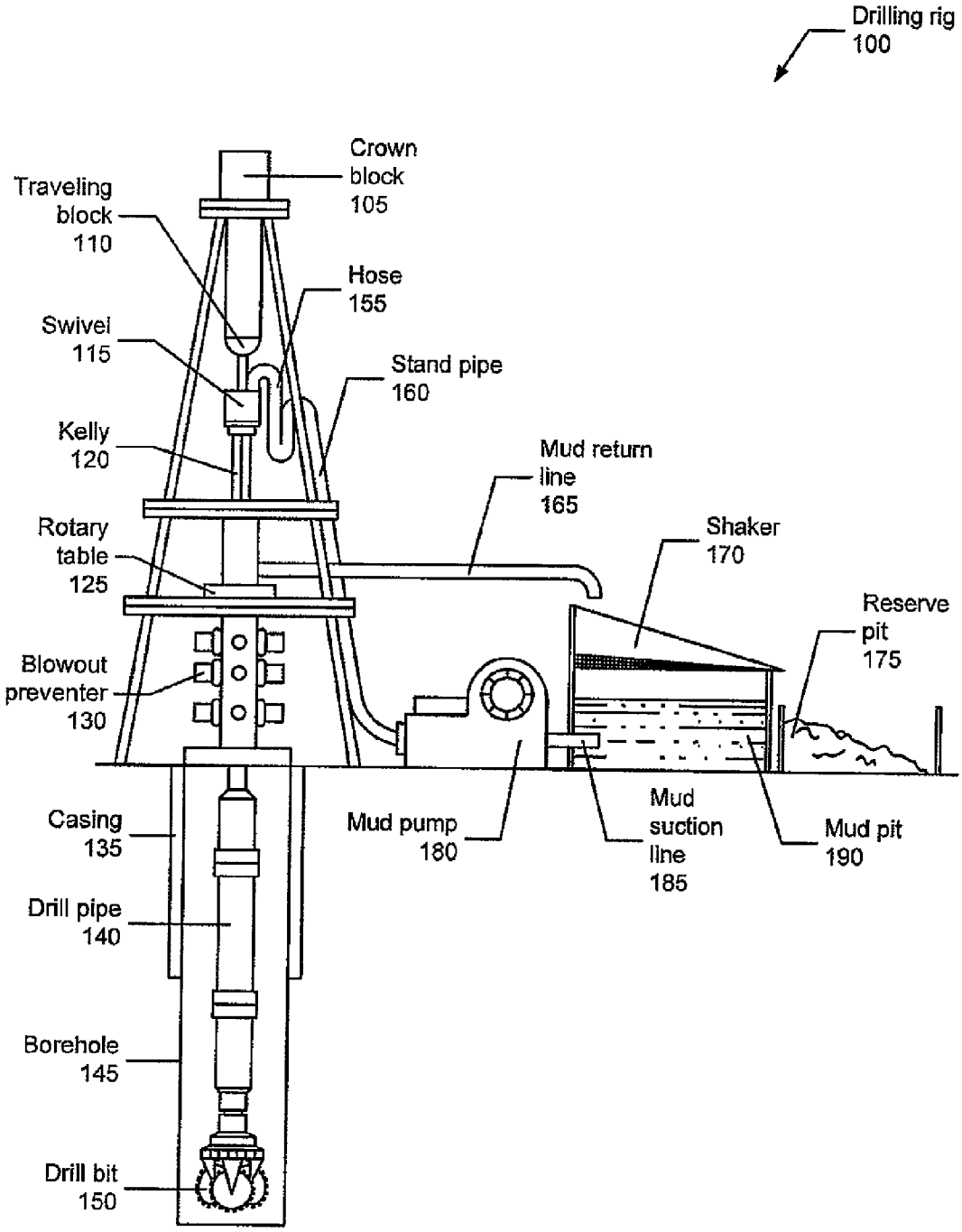
FIGURE 1 (PRIOR ART)
FIG. 1 shows a diagram of an exemplary drilling system for drilling an earth formation.
Figure 2:
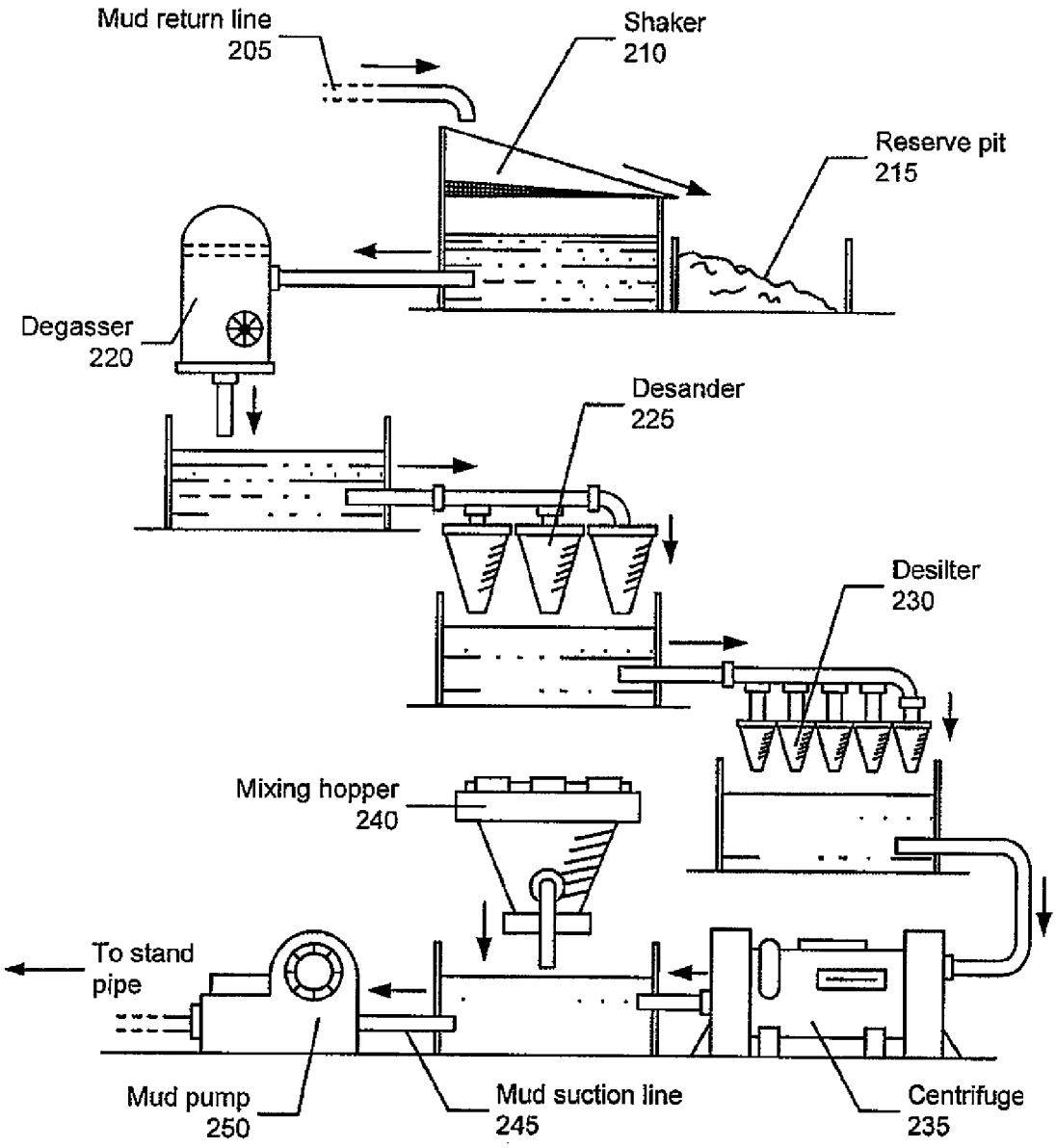
FIGURE 2 (PRIOR ART)
FIG. 2 shows a diagram of an exemplary arrangement of mud treatment devices.

Specific embodiments will now be described in detail with reference to the accompanying figures. Like elements in the various figures are denoted by like reference numerals for consistency.

In the following detailed description, numerous specific details are set forth in order to provide a more thorough understanding of the disclosed embodiments. However, it will be apparent to one of ordinary skill in the art that one or more embodiments may be practiced without these specific details. In other instances, well-known features have not been described in detail to avoid unnecessarily complicating the description.

In general, one or more disclosed embodiments provide a method and system to control a peripheral drilling operation using a wireless network. Properties of drilling operation components are obtained, at least one of the properties being obtained via the wireless network. A control signal for a drilling operation component is generated, based on the properties, and the drilling operation component is adjusted based on the control signal, to control the peripheral drilling operation.

Figure 3:
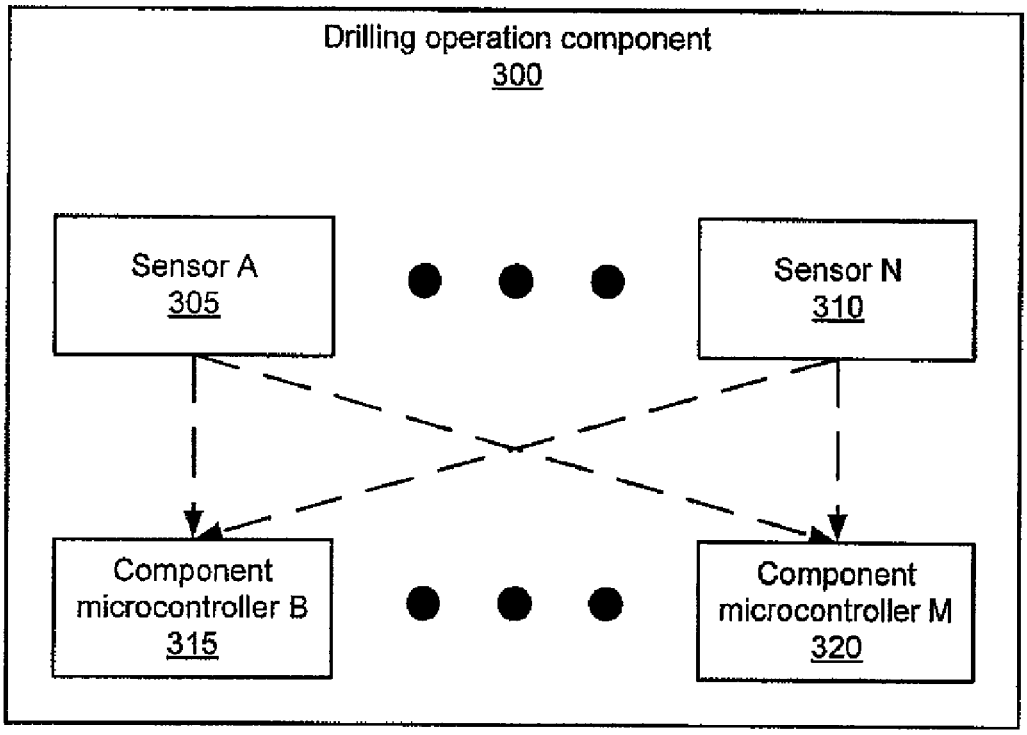
FIG. 3 shows a diagram of a drilling operation component in accordance with one or more disclosed embodiments.

FIG. 3 shows a diagram of a drilling operation component (300) in accordance with one or more disclosed embodiments. For example, the drilling operation component (300) may be a shaker, degasser, desander, desilter, centrifuge, mixing hopper, or any other type of component associated with a peripheral drilling operation. The drilling operation component (300) includes one or more sensors (e.g., sensor A (305), sensor N (310)) configured to obtain properties associated with the drilling operation component (300). The sensor(s) (e.g., 305) may be configured to obtain a temperature, a viscosity, a force measurement, a pH, a rock hardness, or any other measurable property of the drilling operation component (300). For example, if the drilling operation component (300) is a shaker, one or more of the sensors (e.g., 305, 310) may be configured to obtain the shaker's current deck angle. As another example, if the drilling operation component (300) is a mud pit, one or more of the sensors (e.g., 305, 310) may be configured to obtain the mud pit's current fluid depth. Those having ordinary skill in the art will appreciate that depending on the drilling operation component (300), a number of potentially useful measurements may be made.

Further, each of the sensors (e.g., 305, 310) may be associated with one or more component microcontrollers (e.g., component microcontroller B (315), component microcontroller M (320)). The component microcontrollers (e.g., 315, 320) may include hardware components, software modules, or any combination thereof. For example, a component microcontroller (e.g., 315, 320) may be an embedded device operatively connected to the drilling operation component (300). Further, multiple types of component microcontrollers (e.g., 315, 320) may be used concurrently in the drilling operation component (300). In some cases, multiple sensors (e.g., 305, 310) may be associated with a single component microcontroller (e.g., 315, 320).

One or more of the component microcontrollers (e.g., 315, 320) may be configured to obtain a property of the drilling operation component (300) from an associated sensor (e.g., 305, 310). Further, one or more of the component microcontrollers (e.g., 315, 320) may be configured to transmit and/or obtain properties via a wireless network, as discussed below. Moreover, one or more of the component microcontrollers (e.g., 315, 320) may be configured to adjust the drilling operation component (300). For example, if the drilling operation component (300) is a shaker, then a component microcontroller (e.g., 315, 320) may be configured to adjust the deck angle of the shaker. Other software and/or hardware elements (not shown) of the drilling operation component (300) may also be involved in the adjustment. For example, the component microcontroller (e.g., 315, 320) may be operatively connected to a hardware controller interface (not shown) for adjusting the drilling operation component (300).

Figure 4:
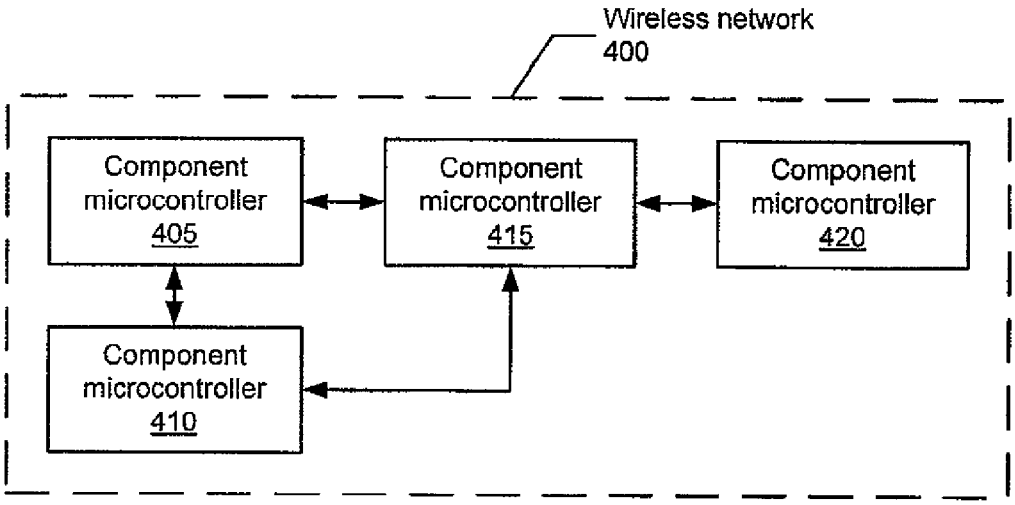
FIG. 4 shows a diagram of a wireless network in accordance with one or more disclosed embodiments.

As discussed above, one or more component microcontrollers may be configured to transmit and/or obtain properties of drilling operation components via a wireless network. FIG. 4 shows a diagram of a wireless network (400) in accordance with one or more disclosed embodiments. Specifically, FIG. 4 shows a diagram of multiple component microcontrollers (e.g., 405, 410, 415, 420) configured to communicate wirelessly, in accordance with one or more disclosed embodiments. For example, the component microcontrollers (e.g., 405, 410, 415, 420) may be configured to communicate using 802.11, ZigBee, or any other type of wireless communication. Further, the wireless network (400) may be an ad-hoc network, a grid network, a mesh network, a ring network, any other type of network, or any combination thereof.

The wireless network (400) may include any number of component microcontrollers (e.g., 405, 410, 415, 420), depending, for example, on the drilling operation components used, the arrangement of the drilling operation components (e.g., the distance between the drilling operation components), the types of component microcontrollers (e.g., 405, 410, 415, 420), the type of wireless communication used, or any other similar factor.

As shown in FIG. 4, one or more of the component microcontrollers (e.g., 405, 410, 415, 420) may be configured to communicate indirectly, i.e., via another component microcontroller (e.g., 405, 410, 415, 420). For example, component microcontroller (410) and component microcontroller (420) are configured to communicate via component microcontroller (415). Component microcontroller (410) and component microcontroller (420) may not be specifically configured to communicate with each other; rather, component microcontroller (410) may simply broadcast an obtained property to other nearby component microcontrollers (in this example, component microcontrollers (405, 415)). The receiving component microcontrollers (e.g., 405, 415) may in turn also broadcast the obtained property. In this manner, the obtained property may be broadcast, directly or indirectly, across the wireless network (400).

In one or more disclosed embodiments, use of a wireless network may facilitate communication between drilling operation components. Further, if the wireless network is an ad-hoc network, drilling operation components may be easily added and/or removed from the wireless network. Moreover, allowing indirect transmitting of properties between component microcontrollers may extend the operable range of the wireless network and/or increase the number of properties that are available for use.

Figure 5:
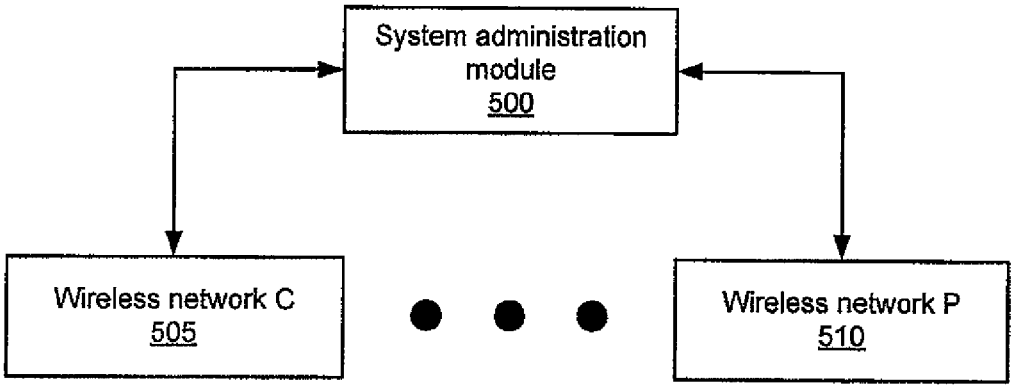
FIG. 5 shows a diagram of a system in accordance with one or more disclosed embodiments.

FIG. 5 shows a diagram of a system in accordance with one or more disclosed embodiments. Specifically, FIG. 5 shows a diagram of one or more wireless networks (e.g., wireless network C (505), wireless network P (510)) communicatively coupled with a system administration module (500), in accordance with one or more disclosed embodiments. The system administration module (500) may be a software program, an automated computer system, an interactive computer console, an electronic device, any other similar type of module, or any combination thereof. For example, the system administration module (500) may be a software program displaying an administrative interface on an interactive computer console.

In this exemplary embodiment, the system administration module (500) is configured to obtain drilling operation component properties broadcast from the wireless network(s) (e.g., 505, 510). Based on the properties, the system administration module (500) may generate a control signal for adjusting a drilling operation component, and communicate the control signal to the drilling operation component via the wireless network(s) (e.g., 505, 510). The drilling operation component to be adjusted may be a drilling operation component from which a property was received, or any other drilling operation component.

Figure 6:
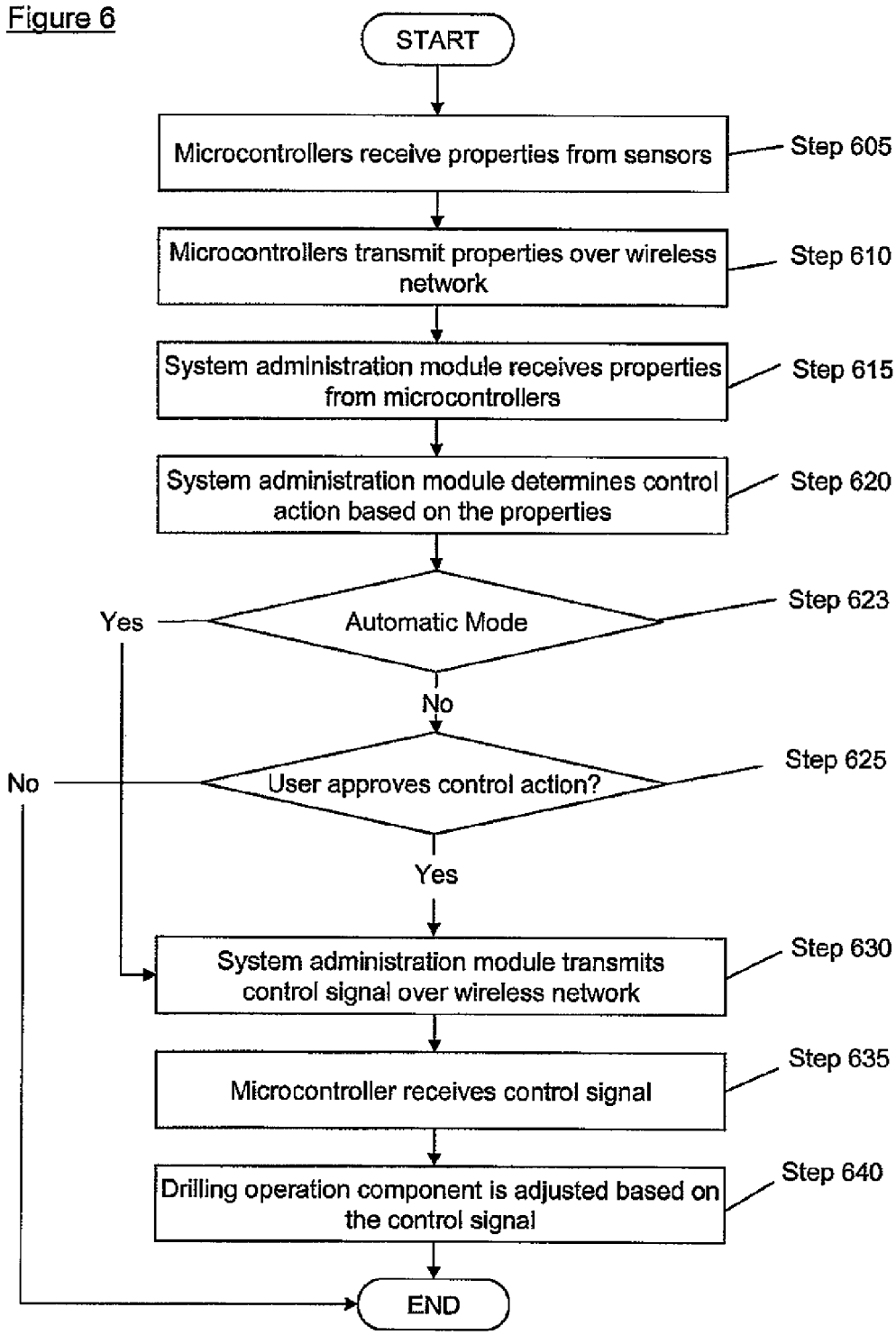
FIGS. 6-7 show diagrams of flowcharts in accordance with one or more disclosed embodiments.

FIG. 6 shows a diagram of a flowchart in accordance with one or more disclosed embodiments. Specifically, FIG. 6 shows a diagram of a method by which a drilling operation component is adjusted, in accordance with one or more disclosed embodiments. Initially, microcontrollers disposed in multiple drilling operation components receive properties from sensors with which they are associated (Step 605). The microcontrollers transmit the properties over a wireless network (Step 610), and a system administration module receives the transmitted properties (Step 615).

Based on the received properties, the system administration module determines a control action for adjusting a drilling operation component (Step 620). For example, the control action may be to adjust the deck angle of a shaker, based on a property indicating the current deck angle and a property indicating the depth of the mud pit. In certain aspects, the system administration module then automatically selects the control action for the drilling operation component via an automatic mode (Step 623). In one or more disclosed embodiments, user approval may be required for the control action (Step 625). For example, the system administration module may display a prompt requesting approval from a user. If the user does not approve the control action, the method ends. If the user does approve the control action, the system administration module generates a control signal based on the control action, and transmits the control signal over the wireless network (Step 630). Alternatively, if no user approval is required, the method may proceed directly from Step 620 to Step 630.

In Step 635, a microcontroller associated with the drilling operation component to be adjusted receives the control signal. Based on the control signal, the microcontroller adjusts the drilling operation component (Step 640). In one or more disclosed embodiments, the adjustment may result in an improved (e.g., less expensive to operate, more efficient, less dangerous, etc.) peripheral drilling operation. Further, if user approval of the control action is not required, the number of people required to operate the peripheral drilling operation may be reduced. In peripheral drilling operations in dangerous locations (for example, deep sea drilling operations in turbulent waters), reducing the number of required personnel may provide a safety benefit and even save lives.

As discussed above, in one or more disclosed embodiments, a system administration module may be used to generate a control signal for a drilling operation component. Alternatively, in one or more disclosed embodiments, a system administration module may not be required. Specifically, one or more of the microcontrollers may include hardware, software, or any combination thereof for generating a control signal without using a system administration module.

Figure 7:
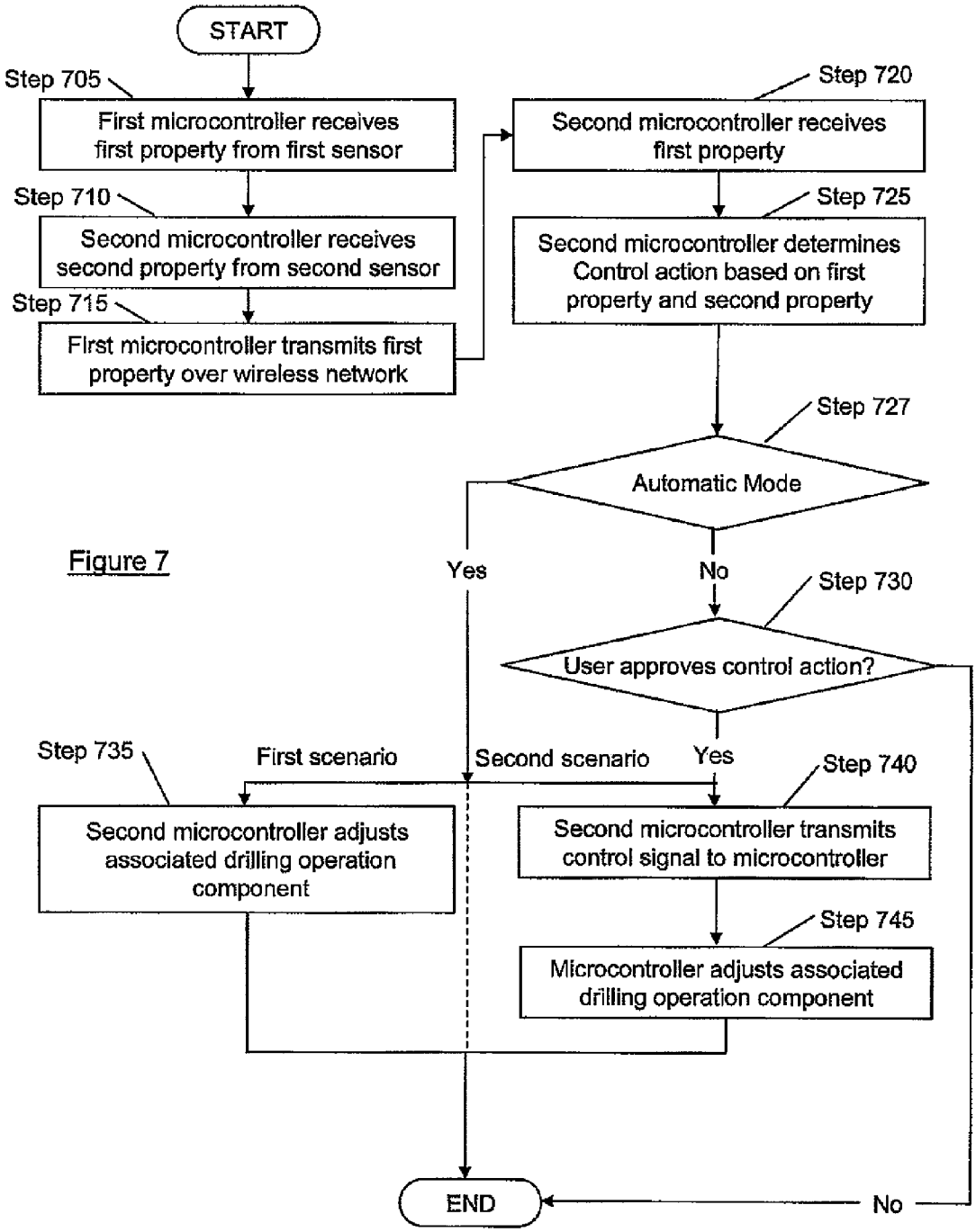

FIG. 7 shows a diagram of a flowchart in accordance with one or more disclosed embodiments. Specifically, FIG. 7 shows a diagram of a method for adjusting a drilling operation component without using a system administration module, in accordance with one or more disclosed embodiments. In the following discussion, "first" and "second" are used only for distinguishing purposes—e.g., to distinguish one microcontroller from another microcontroller. Accordingly, no ordering should be inferred from the use of these terms.

Initially, a first microcontroller receives a first property of a first drilling operation component from a first sensor (Step 705) and a second microcontroller receives a second property of a second drilling operation component from a second sensor (705). The first microcontroller transmits the first property over the wireless network (Step 715), and the second microcontroller receives the transmitted first property (Step 720).

Based on the first property and the second property, the second microcontroller determines a control action for adjusting a drilling operation component (Step 725). The drilling operation component to be adjusted may be the first drilling operation component, the second drilling operation component, or any other drilling operation component. In certain aspects, the control action may be approved via an automatic mode (Step 727). However, in one or more disclosed embodiments, user approval may be required for the control action (Step 730). For example, the second microcontroller may be communicatively coupled with a display device, and use the display device to prompt a user for approval. If the user does not approve the control action, the method ends. If no user approval is required, Step 730 is not performed.

If the drilling operation component to be adjusted is the second drilling operation component, the second microcontroller adjusts the drilling operation component with which it is associated (Step 735). Alternatively, if the drilling operation component to be adjusted is the first drilling operation component, or any other drilling operation component, the second microcontroller generates a control signal based on the control action, and transmits the control signal over the wireless network, to be received by a microcontroller associated with the drilling operation component to be adjusted (Step 740). The microcontroller receives the control signal and adjusts the drilling operation component accordingly (Step 745).

In one or more disclosed embodiments, if a system administration interface is not required, control of the peripheral drilling operation may be distributed across multiple component microcontrollers. In such cases, if a controlling component microcontroller fails, another component microcontroller may be able to assume control of the peripheral drilling operation. Accordingly, one or more disclosed embodiments may improve continuity of the peripheral drilling operation. Further, relegating control of the peripheral drilling operation to a component microcontroller may allow for transparent execution of complex operation decisions, with minimal user interaction. As discussed above, if fewer people are required to operate the peripheral drilling operation, financial and/or safety benefits may result.

Figure 8:
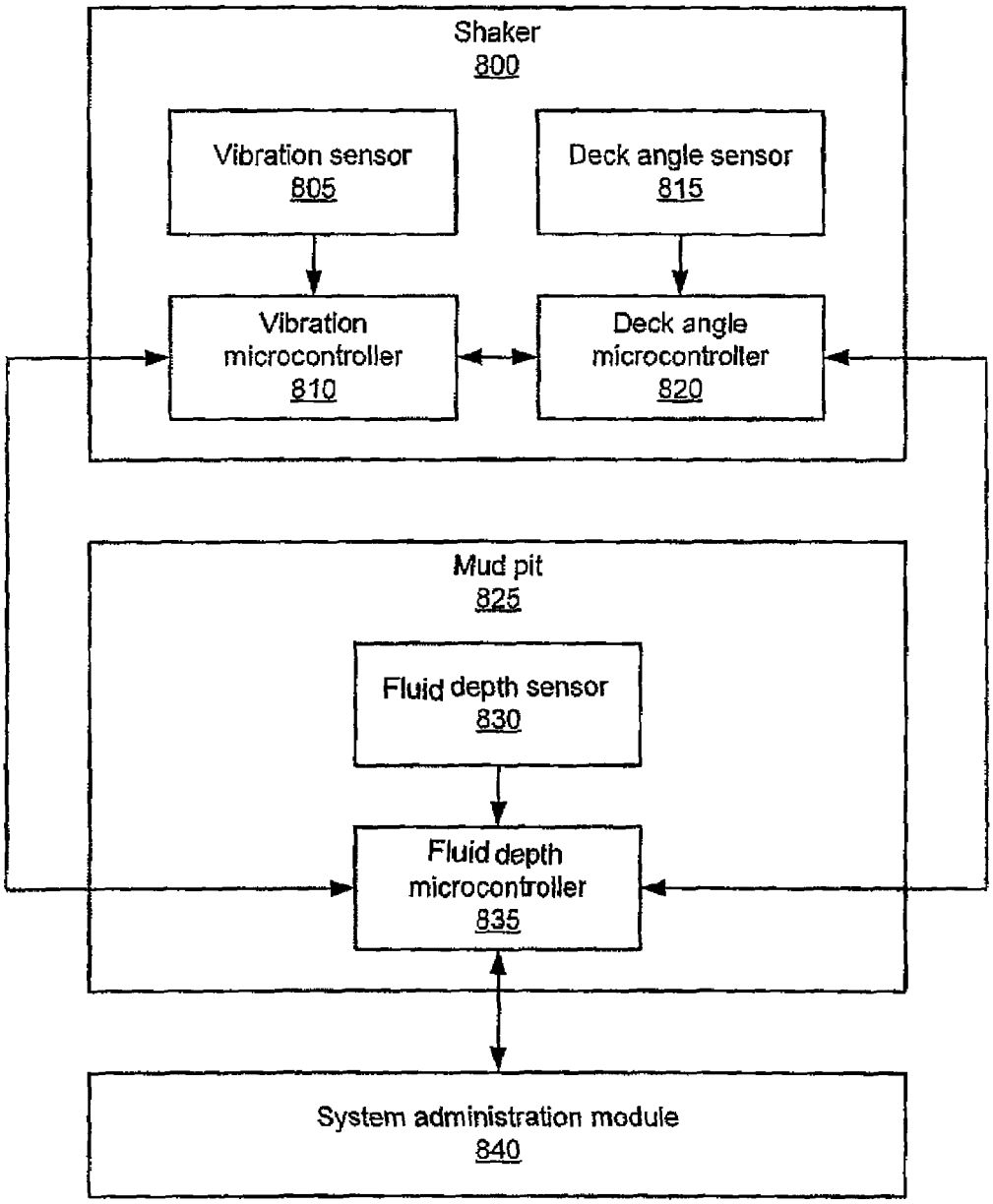
FIG. 8 shows a diagram of a system in accordance with one or more disclosed embodiments.

FIG. 8 shows a diagram of a system in accordance with one or more disclosed embodiments. Specifically, FIG. 8 shows a diagram of an exemplary system, illustrating an example of how a drilling operation component may be adjusted, in accordance with one or more disclosed embodiments. In this embodiment, the system includes a shaker (800), mud pit (825), and system administration module (840), communicatively connected via a wireless network. A vibration sensor (805) associated with the shaker (800) is configured to obtain a property indicating the shaker's (800) vibration rate, and a deck angle sensor (815) associated with the shaker (800) is configured to obtain a property indicating the shaker's (800) deck angle. Further, a vibration microcontroller (810) and deck angle microcontroller (820) are configured to obtain the vibration property and deck angle property from the vibration sensor (805) and deck angle sensor (815), respectively. In addition, a fluid depth sensor (830) associated with the mud pit (825) is configured to obtain a property indicating the depth of fluids in the mud pit (830), and a fluid depth microcontroller (835) is configured to obtain the fluid depth property from the fluid depth sensor (830).

As discussed above, the shaker (800), mud pit (825), and system administration module (840) are communicatively coupled via a wireless network. Specifically, the vibration microcontroller (810), deck angle microcontroller (820), and fluid depth microcontroller (835) are configured to send and receive properties over the wireless network. For example, as shown in FIG. 8, the fluid depth microcontroller (835) is configured to receive vibration and deck angle properties, and rebroadcast them (in addition to the fluid depth property) over the wireless network.

The system administration module (840) is configured to receive the properties and, based on the properties, determine a control action for the shaker (800) and/or mud pit (825). For example, based on the vibration rate, the deck angle, and fluid depth properties, the system administration module (840) may transmit a control signal for the vibration microcontroller (810) to increase or decrease the shaker's (800) vibration rate, or transmit a control signal for the deck angle microcontroller (820) to increase or decrease the shaker's (800) deck angle. The preceding discussion of FIG. 8 is merely exemplary, and many other types of adjustment exist.

Figure 9:
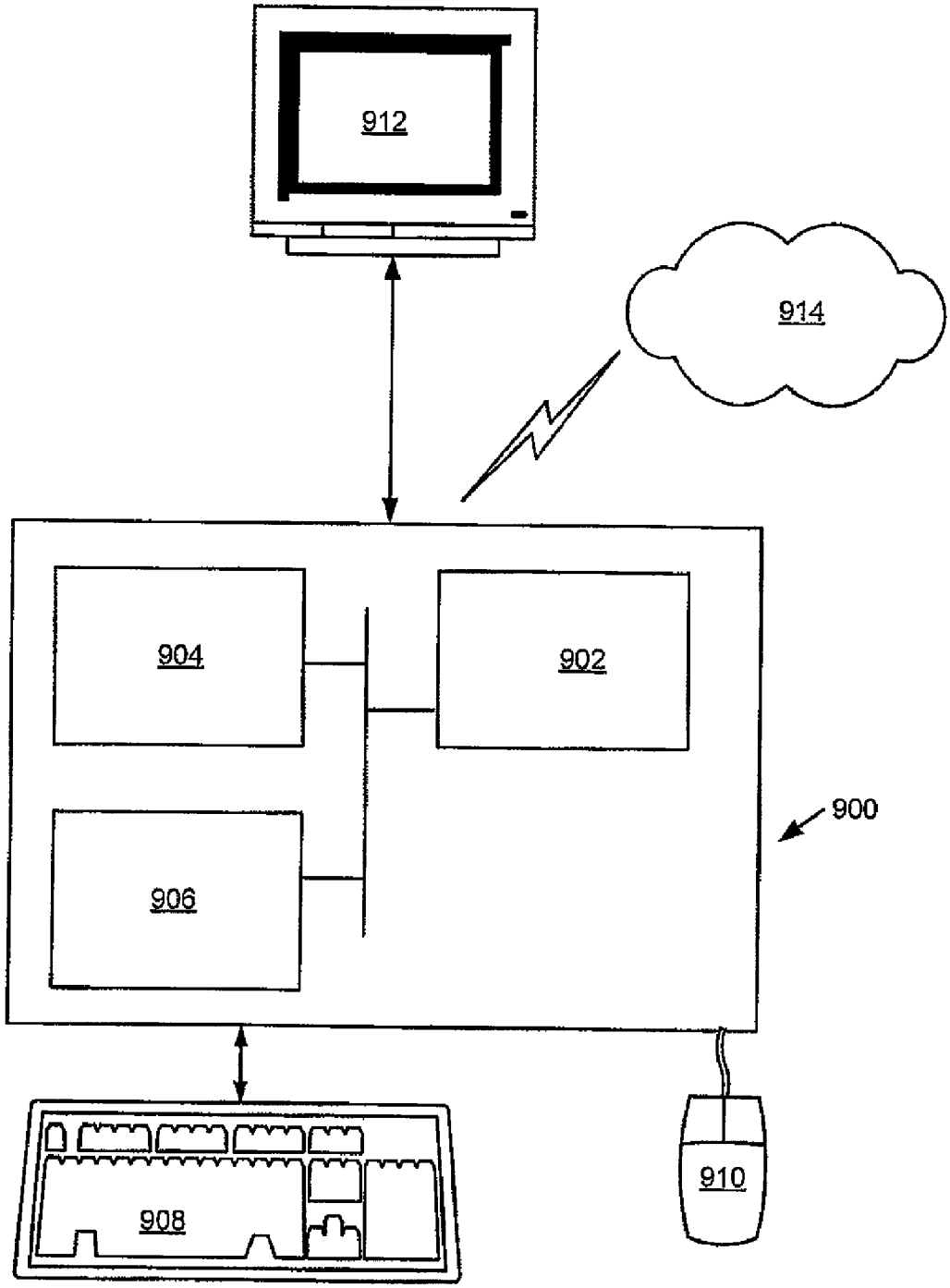
FIG. 9 shows a diagram of a computer system in accordance with one or more disclosed embodiments.

One or more embodiments may be implemented on virtually any type of computer regardless of the platform being used. For example, as shown in FIG. 9, a computer system (900) includes a processor (902), associated memory (904), a storage device (906), and numerous other elements and functionalities typical of today's computers (not shown). The computer (900) may also include input means, such as a keyboard (908) and a mouse (910), and output means, such as a monitor (912). The computer system (900) may be connected to a network (914) (e.g., a local area network (LAN), a wide area network (WAN) such as the Internet, or any other similar type of network) via a network interface connection (not shown). Those skilled in the art will appreciate that these input and output means may take other forms.

Further, those skilled in the art will appreciate that one or more elements of the aforementioned computer system (900) may be located at a remote location and connected to the other elements over a network. Further, one or more embodiments may be implemented on a distributed system having a plurality of nodes, where each portion of the one or more embodiments (e.g., drilling operation component, sensor, component microcontroller, wireless network, system administration module, etc.) may be located on a different node within the distributed system. In one or more embodiments, the node corresponds to a computer system. Alternatively, the node may correspond to a processor with associated physical memory. The node may alternatively correspond to a processor with shared memory and/or resources. Further, software instructions to perform one or more embodiments may be stored on a computer readable medium such as a compact disc (CD), a diskette, a tape, a file, or any other computer readable storage device.

While a limited number of embodiments are described above, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for controlling a peripheral drilling operation, comprising:

obtaining a first property of a first drilling operation component associated with the peripheral drilling operation, via a wireless network;

obtaining a second property of a second drilling operation component associated with the peripheral drilling operation;

generating a control signal for the first drilling operation component, based on the first property and the second property, wherein the control signal is generated based on at least one of an upstream and a downstream process; and communicating the control signal to the first drilling operation component, via the wireless network, wherein the first drilling operation component is adjusted, based on the control signal, to control the peripheral drilling operation.

2. The method of claim 1, wherein obtaining the second property is performed via the wireless network.

3. The method of claim 1, further comprising:

prompting a user to approve or reject communicating the control signal to the first drilling operation component.

4. The method of claim 1, wherein the peripheral drilling operation is associated with an oilfield drilling operation.

5. The method of claim 1, wherein the peripheral drilling operation is selected from the group consisting of waste management, cuttings management, fluid creation, fluid treatment, and mud re-injection.

6. The method of claim 1, wherein the wireless network comprises a mesh network.

7. A system for controlling a peripheral drilling operation, comprising:

a first microcontroller configured to:

obtain a first property of a first drilling operation component associated with the peripheral drilling operation, and communicate the first property to a system administration module, via a wireless mesh network; and the system administration module configured to:

determine a control signal for the first drilling operation component, based on the first property and a second property of a second drilling operation component associated with the peripheral drilling operation, and communicate the control signal to the first microcontroller, via the wireless mesh network, wherein the first drilling operation component is adjusted, based on the control signal, to control the peripheral drilling operation.

8. The system of claim 7, further comprising:

a second microcontroller configured to:

obtain the second property, and communicate the second property to the system administration module via the wireless mesh network.

9. The system of claim 7, wherein the system administration module is further configured to:

prompt a user to approve or reject communicating the control signal to the first drilling operation component.

10. The system of claim 7, wherein the peripheral drilling operation is associated with an oilfield drilling operation.

11. The system of claim 7, wherein the peripheral drilling operation is selected from the group consisting of waste management, cuttings management, fluid creation, fluid treatment, and mud re-injection.

12. A method for controlling a peripheral drilling operation, comprising:

obtaining a first property of a first drilling operation component associated with the peripheral drilling operation;

obtaining a second property of a second drilling operation component associated with the peripheral drilling operation;

communicating the first property to a microcontroller associated with the second drilling operation component, via a wireless network; and adjusting the second drilling operation component based on the first property and the second property, wherein at least one of the first and second properties is obtained from an upstream or downstream process, to control the peripheral drilling operation.

13. The method of claim 12, further comprising:

prompting a user to approve or reject adjusting the second drilling operation component.

14. The method of claim 12, wherein the peripheral drilling operation is associated with an oilfield drilling operation.

15. The method of claim 12, wherein the peripheral drilling operation is selected from the group consisting of waste management, cuttings management, fluid creation, fluid treatment, and mud re-injection.

16. The method of claim 12, wherein the wireless network comprises a mesh network.

17. A system for controlling a peripheral drilling operation, comprising:

a first microcontroller configured to:

obtain a first property of a first drilling operation component associated with the peripheral drilling operation, and communicate the first property to a second microcontroller, via a wireless network; and the second microcontroller configured to:

obtain a second property of a second drilling operation component associated with a drilling process, and adjust the second drilling operation component, based on the first property and the second property.

18. The system of claim 17, wherein the second microcontroller is further configured to:

prompt a user to approve or reject adjusting the second drilling operation component.

19. The system of claim 17, wherein the peripheral drilling operation is associated with an oilfield drilling operation.

20. The system of claim 17, wherein the peripheral drilling operation is selected from the group consisting of waste management, cuttings management, fluid creation, fluid treatment, and mud re-injection.

21. The system of claim 17, wherein the wireless network comprises a mesh network.

* * * * *